United States Patent [19]

Yamada

[11] Patent Number: 4,528,951

[45] Date of Patent: Jul. 16, 1985

[54] FUEL INJECTION VALVE FOR INTERNAL COMBUSTION ENGINES

[75] Inventor: Keiichi Yamada, Higashimatsuyama, Japan

[73] Assignee: Diesel Kiki Co., Ltd., Tokyo, Japan

[21] Appl. No.: 612,007

[22] Filed: May 18, 1984

[30] Foreign Application Priority Data

May 30, 1983 [JP] Japan ..... 58-81638[U]

[51] Int. Cl.[3] ..... F02B 3/00

[52] U.S. Cl. ..... 123/300; 123/446; 239/533.3; 239/533.4

[58] Field of Search ..... 123/446, 299, 300, 500–504; 239/533.3–533.12

[56] References Cited

U.S. PATENT DOCUMENTS

| | | | |
|---|---|---|---|
| 2,594,681 | 4/1952 | Ricardo et al. | 123/300 |
| 3,559,892 | 2/1971 | De Luca | 239/533.4 |
| 4,022,165 | 5/1977 | Eckert et al. | 123/300 |
| 4,171,099 | 10/1979 | Kopse et al. | 123/446 |
| 4,403,740 | 9/1983 | Eblen et al. | 239/533.4 |

FOREIGN PATENT DOCUMENTS

| | | | |
|---|---|---|---|
| 2655793 | 6/1978 | Fed. Rep. of Germany | 123/300 |
| 56-141051 | 11/1981 | Japan . | |
| 57-102527 | 6/1982 | Japan . | |
| 1014131 | 12/1965 | United Kingdom | 123/300 |
| 1420931 | 1/1976 | United Kingdom | 239/533.3 |

*Primary Examiner*—Magdalen Y. C. Moy
*Attorney, Agent, or Firm*—Frishauf, Holtz, Goodman & Woodward

[57] ABSTRACT

The nozzle body has a main nozzle hole and a sub nozzle hole formed therein, the latter being directed at a predetermined angle with the former and smaller in discharge area than the former. The nozzle needle slidably received in the nozzle body is disposed such that its tip is fitted in the main nozzle hole when the nozzle needle is in a seated position thereof, and the tip substantially remains in the main nozzle hole during lifting of the nozzle needle before the nozzle needle lifts through a predetermined stroke, whereby fuel is injected substantially solely through the sub nozzle hole in a first predetermined direction, while the tip of the nozzle needle substantially comes out of the main nozzle hole after the nozzle needle has lifted through the predetermined stroke, whereby fuel is injected mainly through the main nozzle hole in a second predetermined direction different from the first predetermined direction by the above predetermined angle. Control means is responsive to operating conditions of the engine to allow the nozzle needle to lift only through the above predetermined stroke in a low speed/low load region of the engine, while allowing the nozzle needle to lift beyond the predetermined stroke in a high speed/high load region of the engine.

4 Claims, 5 Drawing Figures

FUEL INJECTION VALVE FOR INTERNAL COMBUSTION ENGINES

BACKGROUND OF THE INVENTION

This invention relates to a fuel injection valve for internal combustion engines, which can be controlled in injection rate and injecting direction in response to operating conditions of the engine.

Fuel injection valves generally employed in Diesel engines are typically comprised of a nozzle body having an end wall formed with at least one nozzle hole, and a nozzle needle slidably received in an axial hole formed in the nozzle body for closing and opening the nozzle hole. Pressurized fuel from a fuel injection pump forcibly lifts the nozzle needle to open the nozzle hole to thereby cause injection of the fuel.

According to such conventional fuel injection valves, due to the pressure characteristic of fuel supplied thereto that the fuel pressure varies in proportion to the rotational speed of the engine, if the discharge area of the nozzle hole or the lifting stroke of the nozzle needle is set at a value appropriate to operation of the engine under a high speed/high load condition, the set value turns out too large for operation of the engine under a low speed/low load condition, which results in too low an injection pressure, often causing abnormal injection.

To overcome this disadvantage, several improved fuel injection valves have been proposed, for instance, a fuel injection valve of variable valve opening pressure type disclosed by Japanese Provisional Patent Publication No. 57-102527, which employs two nozzle springs urging the nozzle needle in the valve closing direction and operable such that when low fuel pressure acts upon the nozzle needle, one of the nozzle springs is compressed, while when high fuel pressure acts upon the nozzle needle, both of the nozzle springs are compressed, to thereby vary the lifting stroke of the nozzle needle in two steps, and a fuel injection valve of nozzle needle lift-controlled type disclosed by Japanese Provisional Patent Publication No. 56-141051, which employs a plunger controlled to restrain lifting of the nozzle needle by means of a control valve formed e.g. of a spool valve operable in response to operating conditions of the engine, to thereby vary the lifting stroke of the nozzle needle in two steps.

These proposed fuel injection valves resort to a common measure to overcome the aforementioned disadvantage, that is, when the engine is operating under a low speed/low load condition including an idling condition, the lifting stroke of the nozzle needle is set to a smaller value (PRE-LIFT) so as to reduce the injection rate, while when the engine is operating under a high speed/high load condition, the lifting stroke of the nozzle needle is set to a larger value (FULL LIFT) so as to increase the injection rate.

In these proposed fuel injection valves equipped with the above injection rate control means are employed throttle nozzles adapted to effect throttling injection and non-throttling or main injection dependent upon the lifting stroke of the nozzle needle. More specifically, when the engine is operating under a low speed/low load condition or during PRE-LIFT of the nozzle needle, the throttling injection is effected to cause ordinary combustion (by evaporation of atomized fuel), while when the engine is operating under a high speed/high load condition or during FULL LIFT of the nozzle needle, the main injection is effected to cause "M Combustion" (by evaporation of fuel adhering to the wall surface of the combustion chamber). However, according to such throttle nozzles, fuel is injected in a single direction irrespective of the mode of injection i.e. throttling injection and main injection, providing the disadvantage that part of injected atomized fuel collides with the wall surface of the combustion chamber even during throttling injection, causing increased emission of HC from the engine.

SUMMARY OF THE INVENTION

It is the object of the invention to provide a fuel injection valve for an internal combustion engine, which can be controlled in injection rate as well as in injecting direction in response to operating conditions of the engine so as to prevent collision of injected atomized fuel with the wall surface of the combustion chamber when the engine is operating under a low speed/low load condition, thereby ensuring positive ordinary combustion and accordingly reducing HC emissions from the engine.

According to the invention, the nozzle body has a main nozzle hole and a sub nozzle hole formed therein, the latter being directed at a predetermined angle with the former and smaller in discharge area than the former. The nozzle needle slidably received in the nozzle body is disposed such that its tip is fitted in the main nozzle hole when the nozzle needle is in a seated position thereof, and the tip substantially remains in the main nozzle hole during lifting of the nozzle needle before the nozzle needle lifts through a predetermined stroke, whereby fuel is injected substantially solely through the sub nozzle hole in a first predetermined direction, while the tip of the nozzle needle substantially comes out of the main nozzle hole after the nozzle needle has lifted through the predetermined stroke, whereby fuel is injected mainly through the main nozzle hole in a second predetermined direction different from the first predetermined direction by the above predetermined angle. Control means is responsive to operating conditions of the engine to allow the nozzle needle to lift only through the above predetermined stroke in a low speed/low load region of the engine, while allowing the nozzle needle to lift beyond the predetermined stroke in a high speed/high load region of the engine.

The above and other objects, features, and advantages of the invention will be more apparent from the ensuing detailed description taken in conjunction with the accompanying drawings.

DETAILED DESCRIPTION

The invention will now be described in detail with reference to the drawings showing embodiments thereof.

Figure 1:
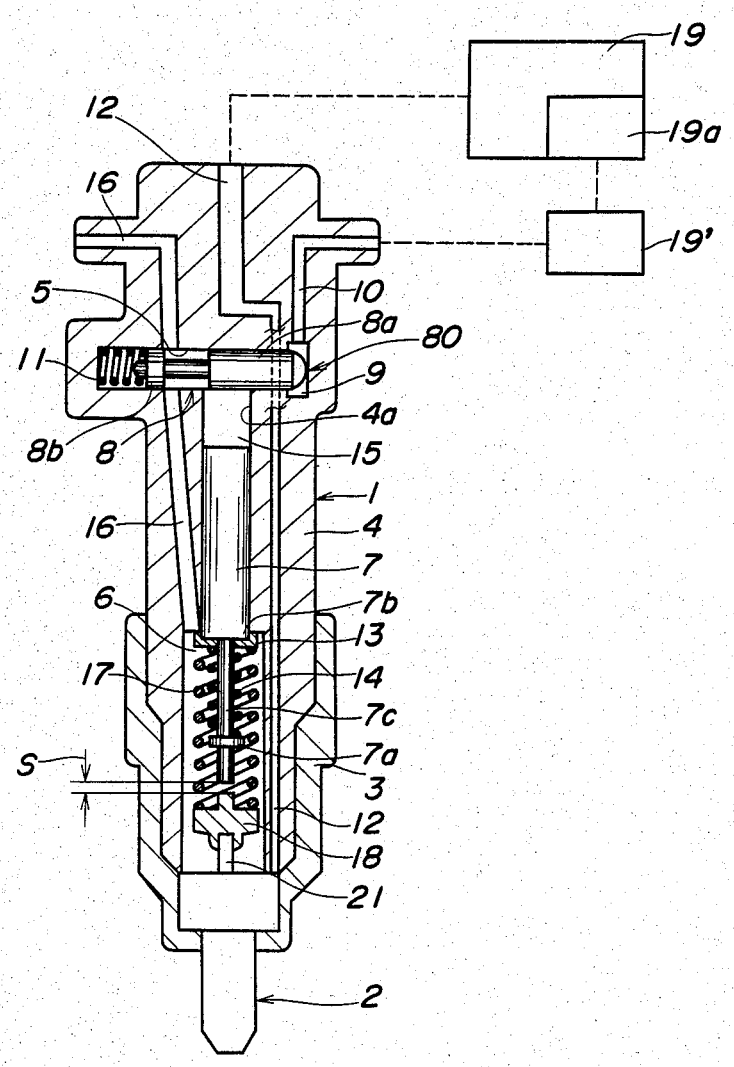
FIG. 1 is a longitudinal sectional view of a fuel injection valve according to an embodiment of the invention.
Figure 2:
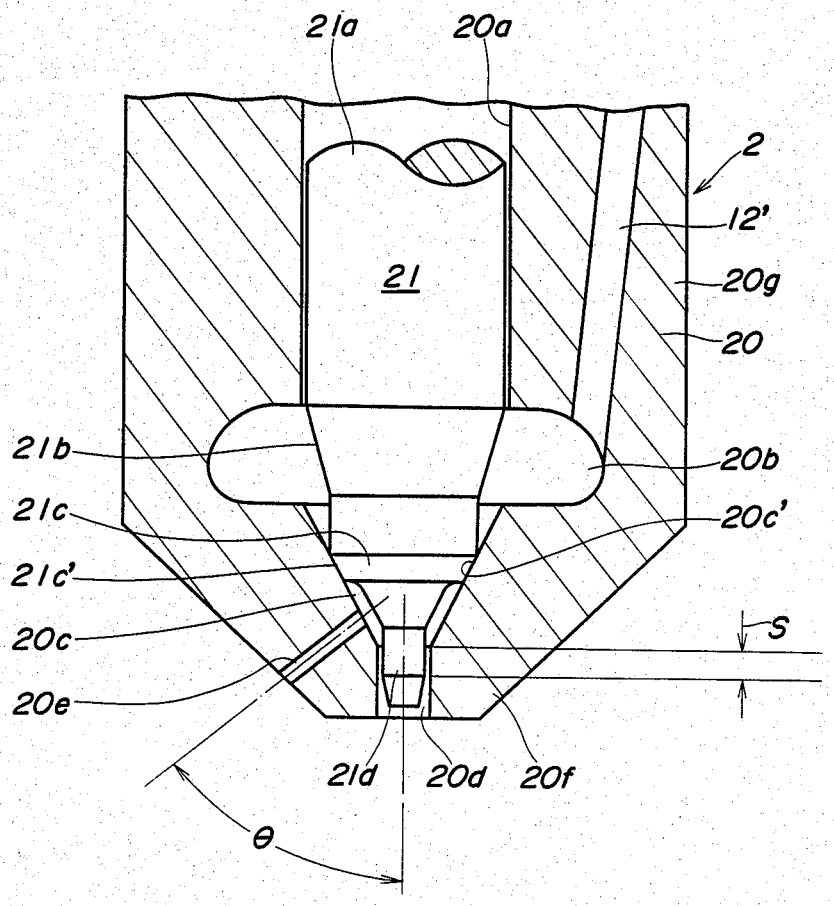
FIG. 2 is a fragmentary sectional view, on an enlarged scale, of the nozzle needle and nozzle body of the fuel injection valve of FIG. 1.

Referring first to FIGS. 1 and 2, there is illustrated a fuel injection valve 1 according to an embodiment of the invention, which includes a nozzle needle lift-control mechanism of the central plunger type as referred to hereinbefore. A fuel injection nozzle 2 is fastened to a nozzle holder 4 by means of a retaining nut 3 in a liquidtight manner. The nozzle holder 4 has its peripheral wall formed with a fuel passage 12 axially extending therethrough with its one end opening in its upper end face and the other end communicating with a pressure chamber 20*b* defined in the nozzle 2.

An axial hole 4*a* is formed through the nozzle holder 4 along its axis, with its upper end opening in the interior of a sleeve 5 radially disposed within the nozzle holder, and its lower end opening in a spring chamber 6 defined in the nozzle holder. Slidably received within the sleeve 5 is a spool 8 forming part of a spool valve 80. The spool 8 has a first land 8*a* and a second land 8*b* spaced from each other by a predetermined distance. In the illustrated position, the first land 8*a* has its semi-spherical end disposed in a pressure chamber 9 formed adjacent an end of the sleeve 5. A suction space pressure-intake passage 10 is connected at its one end with the pressure-applying chamber 9, and opens at its other end in an outer peripheral surface of the nozzle holder 4, to which is to be connected a suction space 19*a* defined in an associated fuel injection pump 19 via switching means 19' arranged outside the fuel injection valve 1. In the suction space 19*a* prevails fuel pressure Pt variable as a function of the rotational speed of the engine. The switching means 19' is responsive to operating parameters of the engine such as engine rpm and load on the engine to allow and interrupt the supply of pressurized fuel from the suction space 19*a* to the pressure chamber 9 through the intake passage 10. The pressurized fuel introduced into the pressure chamber 9 urges the associated end face of the land 8*a* of the land 8 in the leftward direction as viewed in FIG. 1. On the other hand, a coiled spring 11 is arranged in the sleeve 5 in a manner interposed between the second land 8*b* and an opposed end wall of the sleeve 5 and urging the spool 8 in the rightward direction as viewed in FIG. 1. Thus, the spool 8 assumes an axial position within the sleeve 5, in which the force of the coiled spring 11 acting upon the spool 8 and the introduced suction pressure Pt are balanced with each other.

A plunger 7 is slidably received within the axial hole 4*a*, which has its lower half or reduced-diameter portion 7*c* projected into the spring chamber 6 and carries a spring seat 7*a* secured thereon near its lower end. A support member 13 is secured to an open end face of the spring chamber 6 in which the axial hole 4*a* opens, and penetrated along its central hole by the reduced-diameter portion 7*c* of the plunger 7. A coiled spring 14 is interposed between the support member 13 and the spring seat 7*a* of the plunger 7 and urges the plunger 7 in the downward direction. In the illustrated position, the plunger 7 is held by the force of the spring 14 in its lowest position in which its stepped shoulder 7*b* is in urging contact with an upper face of the support member 13. The spring 14 serves to return the plunger 7 once lifted with the lifting motion of the nozzle 2, to the above lowest position when the nozzle 2 is closed.

On the other hand, a stroke-limiting chamber 15 is defined in the nozzle holder 4 by an inner peripheral surface of the axial hole 4*a* and an upper end face of the plunger 7, which opens at one end in the interior of the sleeve 5. When the application of the suction pressure Pt to the pressure chamber 9 is interrupted so that the first land 8*a* of the spool 8 is biased in urging contact with an opposed side wall of the chamber 9, the oil chamber 15 communicates with the interior of the sleeve 5, whereas when the suction pressure Pt is introduced into the chamber 9 so that the spool 8 is biased to the leftward position as viewed in FIG. 1, the open end of the oil chamber 15 is blocked by the first land 8*a* of the spool 8 and accordingly entirely closed.

Further formed in the nozzle holder 4 is an axially extending leakage fuel-draining passage 16 of which one end opens in an upper outer peripheral surface of the nozzle holder 4 and the other end opens in an upper wall surface of the spring chamber 16, with the sleeve 5 disposed across an intermediate portion thereof.

Figure 3:
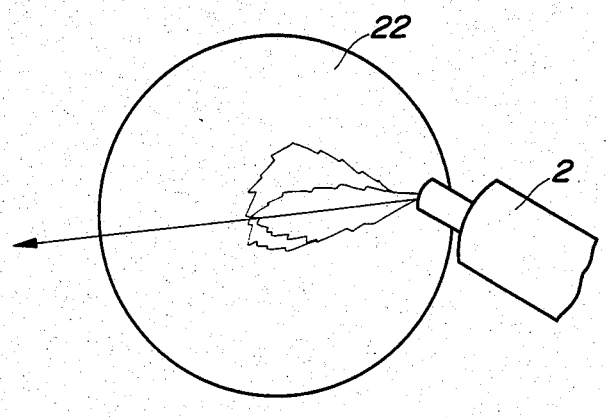
FIG. 3 is a schematic view showing a manner of injection by the fuel injection valve of FIG. 1 at low speed/low load operation of the engine.
Figure 4:
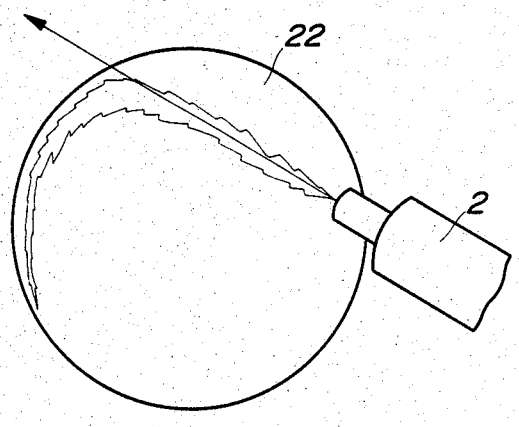
FIG. 4 is a view similar to FIG. 3, at high speed/high load operation of the engine.

As shown in FIG. 2, the fuel injection nozzle 2 is composed of a nozzle body 20, and a nozzle needle 21. The nozzle 2 is mounted in an engine cylinder with tip of the nozzle body 20 projected into a combustion chamber 22 defined within the engine cylinder (FIGS. 3 and 4). The nozzle needle 21 is slidably received within an axial hole 20*a* formed in the nozzle body 20 along its axis. The nozzle needle 21 carries a pressure pin 18 at its upper end (FIG. 1), and in the position of FIG. 2, it is downwardly biased in its seated position by the force of a coiled spring 17 interposed between the support member 13 and the pressure pin 18. When the nozzle needle 21 is in its seated position, a distance S is provided between an lower end face of the plunger and an opposed upper end face of the pressure pin 18. The nozzle body 20 is formed therein with the aforementioned pressure chamber 20*b*, a valve chamber 20*c*, and a main nozzle hole 20*d* which are axially continuously arranged along the axis of the nozzle body 20 and in the mentioned order, at levels lower than the axial hole 20*a*. The valve chamber 20*c* has its peripheral wall surface formed as a valve seat 20*c'*. Further, the nozzle body 20 has its end wall 20*f* formed with a sub nozzle hole 20*e* in the vicinity of the main nozzle hole 20*d*, which opens at one end in a lower portion of the valve seat 20*c'* and at the other end in an outer surface of the end wall 20*f*. The sub nozzle hole 20*e* has its axis obliquely directed at a predetermined angle ($\theta$) with respect to the axis of the main nozzle hole 20*d*, and its diameter, i.e. discharge area set at a value smaller than that of the main nozzle hole 20*d*. The nozzle body 20 also has its peripheral wall 20*g* formed therein with a fuel passage 12' opening at one end in the pressure chamber 20*b* and connected at the other end with the fuel passage 12 formed in the nozzle holder 4.

The nozzle needle 21 is formed of a one-piece material and comprises a valve stem 21*a* slidably received within the axial hole 20*a*, a conical pressure-applying portion 21*b* disposed in the pressure chamber 20*b*, a valve seating portion 21*c* having its outer peripheral surface serving as a valve seating surface 21*c'* seatable on the valve seat 20*c'* of the nozzle body 20, and a pintle 21*d* fittable into the main nozzle hole 20*d*.

The fuel injection valve 1 constructed as above is mounted in the engine cylinder such that the sub nozzle hole 20*e* is directed toward a central zone in the combustion chamber 22 defined within the engine cylinder as shown in FIG. 3, whereas the main nozzle hole 20*d* is directed to a peripheral zone in the same chamber 22 as shown in FIG. 4.

The operation of the fuel injection valve constructed as above will be described hereinbelow. As the fuel injection pump 19 operates together with the rotation of an output shaft of the engine to which it is drivenly connected, pressurized fuel is supplied through the fuel passages 12, 12' into the pressure chamber **20*b*. When the pressure of fuel in the pressure chamber 20*b* reaches a predetermined value, the nozzle needle 21 is forced by an axial component of the fuel pressure force acting upon the periperhal surface of the pressure-applying portion 21*b* of the nozzle needle, against the force of the spring 17 to cause formation of a gap between the valve seating surface 21*c'* and the valve seat 20*c'*. Fuel flows through this gap toward the nozzle holes 20*d*, 20*e*, and is injected into the combustion chamber 22 in the engine cylinder (FIGS. 3 and 4) through the sub nozzle hole 20*e* alone or through both of the nozzle holes 20*d*, 20*e* depending upon the lifting amount of the nozzle needle 21. Part of the fuel in the pressure chamber 20*b* is guided through the gap between the axial hole 20*a* of the nozzle body 20 and the valve stem 21*a* of the nozzle needle 21 while lubricating same, and leaks into the spring chamber 6, etc. to be returned to a fuel tank, not shown, by way of the leakage fuel-draining passage 16**.

When the engine is operating under a low speed/low load condition, the external switching means 19' operates to allow the supply of pressurized fuel having pressure substantially equal to the suction space pressure Pt from the suction space **19*a* of the fuel injection pump 19, into the pressure chamber 9 through the intake passage 10, whereby the first land 8*a* of the spool 8 is urged by the introduced pressurized fuel so that the spool 8 is displaced in the leftward direction as viewed in FIG. 1 against the force of the spring 11 until it reaches a position in which it completely closes the upper open end of the oil chamber 15. Upon this position being reached, the pressure of the fuel becomes balanced with the force of the spring 11 to stop displacement of the spool 8. With this balanced position of the spool 8, the nozzle needle 21 of the nozzle 2 is lifted by the pressure of fuel from the fuel injection pump 19, introduced into the pressure chamber 20*b* through the fuel passages 12, 12', until the upper end face of the pressure pin 18 comes into urging contact with the lower end face of the plunger 7. On this occasion, since the oil chamber 15 is completely closed in a "fuel-pressurizable state", the plunger 7 cannot further lift from its lowest position shown in FIG. 1. Thus, the resulting lifting stroke of the nozzle needle 21 is equal to the aforementioned distance S. This is the aforementioned PRE-LIFT mode. In this mode, the nozzle needle 21 still has its pintle 21*d* fitted in the main nozzle hole 20*d* as shown in FIG. 2, fuel passing through the gap between the valve seat 20*c'* and the valve seating surface 21*c'* is injected into the combustion chamber 22 substantially solely through the sub nozzle hole 20*e* rather than through the main nozzle hole 20*e* due to large flow resistance of the above-mentioned gap. Since the sub nozzle hole 20*e* has a smaller discharge area as previously noted, the injection rate is smaller in this mode. The fuel spray formed by injection through the sub nozzle hole 20*e* is directed toward a central zone in the combustion chamber 22 in accordance with the extending direction of the sub nozzle hole 20*e* as shown in FIG. 3**, the fuel spray will not collide with the wall surface of the combustion chamber, thereby achieving good combustion with reduced HC emissions from the engine.

On the other hand, when the engine is operating under a high speed/high load condition, the communication between the suction space **19*a* and the suction space pressure-intake passage 10 is interrupted by the action of the external switching means 19' so that no fuel is supplied from the suction space 19*a* to the pressure chamber 9. Consequently, the spool 8 is rightwardly displaced by the spring 11 so that the stroke-limiting chamber 15 becomes communicated with the interior of the sleeve 5, i.e. the leakage fuel-draining passage 16, allowing upward movement of the plunger 7. On this occasion, the nozzle needle 21 is allowed to lift through a stroke larger than the distance S, i.e. a full stroke by the fuel pressure acting upon its pressure-applying portion 21*b*, whereby the pintle 21*d* of the nozzle needle 21 completely lifts out of the main nozzle hole 20*d*. Consequently, the discharge area of the main nozzle hole 20*d* suddenly increases to cause injection of fuel into the combustion chamber 22 mainly through the main nozzle hole 20*d* having less flow resistance than the sub nozzle hole 20*e*, resulting in an increased injection rate. The direction of the fuel spray injected through the main nozzle hole 20*d* is substantially tangential to the peripheral wall surface of the combustion chamber 22, i.e. to the swirls in the same chamber, and the fuel spray adheres to the wall surface of the combustion chamber 22** in the form of a film. This fuel film promptly evaporates to form a mixture, and combustion is caused by spontaneous ignition taking place in part of the mixture and spreading to other part thereof, thereby achieving the so-called M Combustion with certainty.

Figure 5:
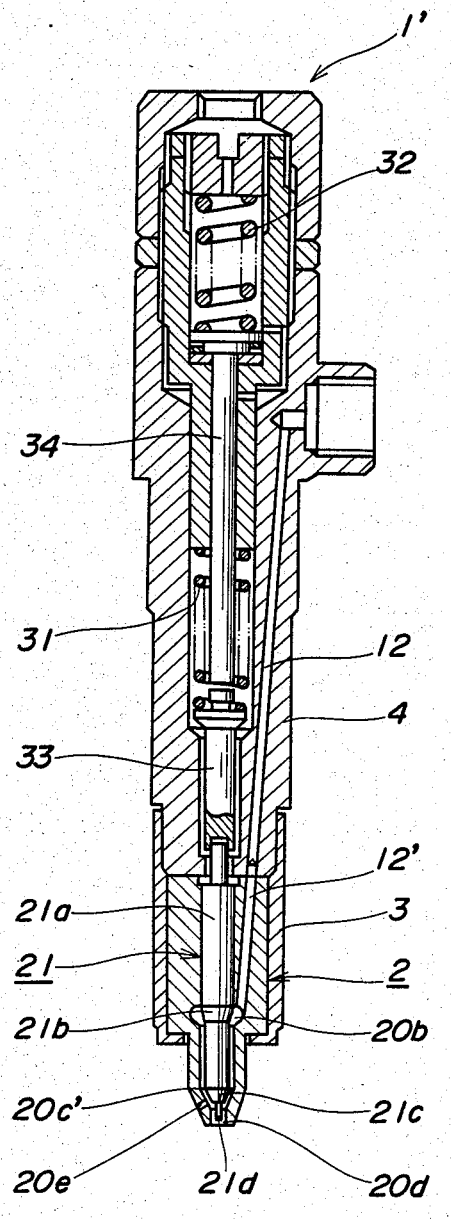
FIG. 5 is a longitudinal sectional view of a fuel injection valve according to another embodiment of the invention.

FIG. 5 illustrates a fuel injection valve according to another embodiment of the invention. The fuel injection valve 1' according to this embodiment is equipped with a control mechanism for varying the valve opening pressure of the valve in two steps, in place of the nozzle needle lift control mechanism of the central plunger type shown in FIG. 1. The other elements or parts of this embodiment are substantially identical in construction and/or arrangement with corresponding ones of the embodiment of FIGS. 1 and 2, description of which is therefore omitted, while they are merely designated by identical reference numerals.

The control mechanism of this embodiment is essentially comprised of first and second nozzle springs 31 and 32 formed of coiled springs, for urging the nozzle needle 21 in the valve closing direction, a first movable spring seat 33 supporting the first nozzle spring 31, and a second movable spring seat 34 supporting the second nozzle spring 32 and disposed to be spaced from the first movable spring seat 33 by a distance equal to the required PRE-LIFT of the nozzle needle 21 when the nozzle needle 21 is in its seated position.

When the pressure of pressurized fuel supplied from the fuel injection pump 19 in FIG. 1 into the pressure chamber **20*b* through the fuel pasages 12, 12' exceeds an initial valve opening pressure for initial injection determined by the force of the first nozzle spring 31, it causes the nozzle needle 21 to lift, which in turn causes corresponding lifting of the first movable spring seat 33 to compress the first nozzle spring 31 or against the force thereof (PRE-LIFT). During this PRE-LIFT, the pressurized fuel in the pressure chamber 20*b* is injected into the combustion chamber 22 of the engine (FIGS. 3 and 4) susbtantially solely through the sub nozzle hole 20*e*** alone.

If the pressure of pressurized fuel exceeds a valve opening pressure for main injection determined by the combined force of the first and second nozzle springs 31, 32, the nozzle needle 21 and accordingly the first movable spring seat 33 further lift to cause lifting of the second movable spring seat 34 as well to compress both the second nozzle spring 32 and the first nozzle spring 31 or against the combined force thereof, thereby achieving FULL LIFT of the nozzle needle 21. During this FULL LIFT of the nozzle needle 21, the pressurized fuel is injected mainly through the main nozzle hole 20*d*.

While preferred embodiments of the invention have been described, variations thereto will occur to those skilled in the art within the scope of the present inventive concepts which are delineated by the appended claims.

What is claimed is:

1. A fuel injection valve for use in an internal combustion engine, comprising:

a nozzle body having a main nozzle hole and a sub nozzle hole formed therein, said sub nozzle hole being directed at a predetermined angle with said main nozzle hole and being smaller in discharge area than said main nozzle hole;

a nozzle holder supporting said nozzle body and having an axial hole formed therein;

a nozzle needle slidably received in said nozzle body, said nozzle needle being disposed such that a tip thereof is fitted in said main nozzle hole when said nozzle needle is in a seated position thereof, and said tip substantially remains in said main nozzle hole during lifting of said nozzle needle before said nozzle needle lifts through a predetermined stroke, whereby fuel is injected substantially solely through said sub nozzle hole in a first predetermined direction, while said tip of said nozzle needle substantially comes out of said main nozzle hole after said nozzle needle has lifted through said predetermined stroke, whereby fuel is injected mainly through said main nozzle hole in a second predetermined direction different from said first predetermined direction by said predetermined angle; and control means responsive to operating conditions of said engine to allow said nozzle needle to lift only through said predetermined stroke in a low speed/-low load operating region of said engine, while allowing said nozzle needle to lift beyond said predetermined stroke in a high speed/high load operating region of said engine;

said control means comprising a plunger slidably received within said axial hole of said nozzle holder, said plunger being disposed to have one end thereof spaced from an associated end of said nozzle needle by a distance equal to said predetermined stroke of said nozzle needle when said nozzle needle is in said seated position thereof; spring means for biasing said nozzle needle in a direction away from said plunger; an oil chamber defined in said nozzle holder by an inner peripheral surface of said axial hole of said nozzle holder and an end face of said plunger remote from said nozzle body, said oil chamber having one side thereof open; valve means for selectively closing and opening said one open side of said oil chamber; and switching means responsive to operating conditions of said engine for actuating said valve means to selectively close and open said one open side of said oil chamber.

2. A fuel injection valve as claimed in claim 1, wherein said engine has at least one cylinder having a combustion chamber defined therein, said fuel injection valve being mounted in a corresponding one of said at least one cylinder such that said main nozzle hole is directed to a peripheral zone in said combustion chamber corresponding to said first predetermined direction, and said sub nozzle hole is directed to a central zone in said combustion chamber corresponding to said second predetermined direction.

3. A fuel injection valve as claimed in claim 1, wherein said spring means comprises a first nozzle spring for urging said nozzle needle in a valve closing direction, said first nozzle spring being disposed to be compressed by lifting of said nozzle needle before said nozzle needle lifts through said predetermined stroke; and a second nozzle spring for urging said nozzle needle in said valve closing direction, said second nozzle spring being disposed to be compressed by further lifting of said nozzle needle together with said first nozzle spring after said nozzle needle has lifted through said predetermined stroke.

4. A fuel injection valve as claimed in claim 3, wherein said control means further comprises a first movable spring seat supporting said first nozzle spring, and a second movable spring seat supporting said second nozzle spring, said second movable spring seat being disposed to be spaced from said first movable spring seat by a distance equal to said predetermined stroke when said nozzle needle is in said seated position thereof, said first movable spring seat being lifted by said lifting of said nozzle needle against the force of said first nozzle spring alone before said nozzle needle lifts through said predetermined stroke, and said first movable spring seat and said second movable spring seat being both lifted by said further lifting of said nozzle needle against the force of the combined force of said first nozzle spring and said second nozzle spring after said nozzle needle has lifted through said predetermined stroke.

* * * * *